US009885529B2

(12) United States Patent
Lewis

(10) Patent No.: US 9,885,529 B2
(45) Date of Patent: Feb. 6, 2018

(54) CONTOURED CAM PIN FOR A ROTATING BOLT

(71) Applicant: KRL Holding Company, Inc., Milan, IL (US)

(72) Inventor: Karl R. Lewis, Moline, IL (US)

(73) Assignee: KRL Holding Company, Inc., Milan, IL (US)

( * ) Notice: Subject to any disclaimer, the term of this patent is extended or adjusted under 35 U.S.C. 154(b) by 0 days.

(21) Appl. No.: 15/260,799

(22) Filed: Sep. 9, 2016

(65) Prior Publication Data

US 2017/0074607 A1 Mar. 16, 2017

Related U.S. Application Data

(60) Provisional application No. 62/217,149, filed on Sep. 11, 2015.

(51) Int. Cl.

| | |
|---|---|
| ***F41A 3/26*** | (2006.01) |
| ***F41A 3/66*** | (2006.01) |
| ***F41A 5/18*** | (2006.01) |
| ***F41A 19/13*** | (2006.01) |

(52) U.S. Cl.
CPC *F41A 3/26* (2013.01); *F41A 3/66* (2013.01); *F41A 5/18* (2013.01); *F41A 19/13* (2013.01)

(58) Field of Classification Search
CPC ..... F41A 3/26
USPC ..... 89/185; 42/126
See application file for complete search history.

(56) References Cited

U.S. PATENT DOCUMENTS

| | | | | |
|---|---|---|---|---|
| 3,648,562 | A * | 3/1972 | Loeble | F41A 19/13 89/148 |
| 4,579,034 | A * | 4/1986 | Holloway | F41A 3/26 42/18 |
| 7,930,968 | B2 * | 4/2011 | Giefing | F41A 3/26 42/16 |
| 8,863,638 | B2 * | 10/2014 | Lewis, III | F41A 3/68 42/16 |
| 2012/0137869 | A1 | 6/2012 | Gomez | |
| 2013/0239795 | A1 | 9/2013 | Lewis, III | |
| 2015/0198394 | A1 | 7/2015 | Hochstrate | |

* cited by examiner

*Primary Examiner* — Reginald Tillman, Jr.
(74) *Attorney, Agent, or Firm* — Woodard, Emhardt, Moriarty, McNett & Henry LLP

(57) ABSTRACT

The present disclosure pertains generally to cam pins for rotating bolt firearms. In certain aspects, the present disclosure provides cam pins having a curved profile along a portion of the cam pin that contacts sides of a cam slot in a bolt carrier. Kits, bolt carrier group assemblies, and firearms are also disclosed.

20 Claims, 6 Drawing Sheets

CONTOURED CAM PIN FOR A ROTATING BOLT

CROSS-REFERENCE TO RELATED APPLICATION

This application claims the benefit of provisional patent application Ser. No. 62/217,149, filed Sep. 11, 2015, which is incorporated herein by reference.

BACKGROUND

The present disclosure pertains generally to firearms. In particular, the present disclosure provides an improved cam pin for a bolt carrier system of a firearm.

The M16 rifle is a standard weapon of choice for many institutions around the world including the U.S. military and many law enforcement agencies. Over the years the M16 has been modified to include a large family of weapons including semi-automatic counterparts which are popular in the civilian sector. Additionally, the M16 design has been scaled up from a .223 (5.56 mm) caliber bullet to 7.62 mm NATO and .308 Winchester as well as shortened into the more compact M4 carbine version of the M16.

Generally, the M16 family of automatic and semi-automatic rifles is based on a gas operated rotating bolt carrier system. The bolt carrier includes a multi-lug bolt that interlocks with corresponding lugs within a barrel extension engaged to the barrel to contain the firing of each round of ammunition. The bolt carrier system includes a rotating mechanism that locks the bolt into place with respect to the barrel extension during the loading step and also includes a corresponding unlocking motion when extracting a spent casing. The bolt includes a spring loaded extractor configured to releasably engage a cartridge as it is loaded into the firing chamber. When the rifle is fired, the interlock bolt contains the firing force by transmitting the force through the lugs to corresponding lugs of the barrel extension.

When a round is fired, gas pressure is vented from a port in the barrel down from the firing chamber and that gas pressure is applied to the bolt carrier system to impart energy in a rearward direction. As the bolt carrier system moves rearwardly, it first rotates the bolt to unlock the bolt lugs from the barrel extension lugs. Then, as it further recoils, the extractor pulls the expended cartridge from the firing chamber. Once the cartridge clears the firing chamber an ejector in the bolt pivots the cartridge about the extractor and ejects the spent cartridge, as is well known in the art. As the bolt carrier system continues to move rearwardly its travel is halted by a spring that then pushes the bolt carrier system forward to engage and chamber another round. This process is repeated as often as desired by a shooter until the last cartridge in a magazine is expended.

Under repeated firing and cycling of the bolt carrier system, some components of the bolt carrier system slide and impact other components of the bolt carrier system, causing wear on at least some of the components. In particular, cam pins of existing bolt carrier systems have been found to suffer from wear which may lead to failure of the cam pin. Thus, there is a desire for cam pins that are wear resistant.

SUMMARY

The present disclosure pertains generally to cam pins for rotating bolt firearms. In certain aspects, the present disclosure provides cam pins having a head portion and an elongate body extending from the head portion, the elongate body having a cam slot engaging segment and a bolt engaging segment, the cam slot engaging segment having a first portion with a first cross-sectional dimension and a second portion with a second cross-sectional dimension, the first cross-sectional dimension being greater than the second cross-sectional dimension, and the first portion being located between the head portion and the second portion. In some instances, the present disclosure provides an improved cam pin for a bolt carrier system of a rotating bolt firearm, the cam pin having a head portion and an elongate body extending from the head portion, wherein the improvement comprises the elongate body having a sloped, curved, and/or stepped profile along a length of the elongate body adjacent to the cam slot of a bolt carrier when the cam pin is inserted into a bolt and bolt carrier.

The present disclosure also provides bolt carrier group kits comprising a bolt carrier defining a cam slot; a bolt including a lug and defining a cam pin opening, the bolt slidably and rotatably receivable within the bolt carrier; and a cam pin having a head portion and an elongate body extending from the head portion, wherein the elongate body having a cam slot engaging segment and a bolt engaging segment; wherein the cam slot engaging segment engages with the cam slot when the cam pin is received in the cam pin opening and the bolt is received in the bolt carrier; wherein the cam slot engaging segment has a first portion with a first cross-sectional dimension and a second portion with a second cross-sectional dimension; wherein the first cross-sectional dimension is greater than the second cross-sectional dimension; and wherein the first portion is located between the head portion and the second portion.

The present disclosure also provides rotating bolt firearms comprising a lower receiver; an upper receiver coupled to the lower receiver; a barrel assembly coupled to the upper receiver; a bolt carrier group assembly movably received in the upper receiver, the bolt carrier group assembly including a bolt carrier and a bolt assembly; a cam pin having a head portion and an elongate body extending from the head portion, wherein the elongate body has a cam slot engaging segment and a bolt engaging segment; wherein the bolt carrier defines a cam slot; wherein the bolt assembly includes a lug and is slidably and rotatably positionable within the bolt carrier and wherein the bolt assembly defines a cam pin opening; wherein the cam pin is received in the cam pin opening and is positioned in and engagable with the cam slot; wherein the cam slot engaging segment has a first portion with a first cross-sectional dimension and a second portion with a second cross-sectional dimension; wherein the first cross-sectional dimension is greater than the second cross-sectional dimension; and wherein the first portion is located between the head portion and the second portion.

In some instances, the cam pin has a sloped, curved, and/or stepped profile along a length of the cam pin that includes both the first and second portions and contacts sides of a cam slot in a bolt carrier. Additionally or alternatively, the cam slot engaging segment can have a cross-sectional dimension equal to or less than a cross-sectional dimension of the bolt engaging segment. In some instances, the cam slot engaging segment has a central portion, a first end, and a second end; the first end positioned between the central portion and the head portion and the second end positioned between the central portion and the bolt engaging portion; and wherein the central portion of the cam slot engaging segment has a greater cross-sectional dimension than the first end of the cam slot engaging segment. In some instances, the central portion of the cam slot engaging segment has a greater cross-sectional dimension than the bolt engaging segment.

It is intended that the herein disclosed improvement to cam pins can be used with U.S Military and NATO M16 bolts and bolt carriers including M4 variants and weapons based on the M16 design but chambered in different calibers such as 7.62 NATO. It should also be understood that the improved cam pins disclosed herein can be used with other weapon systems that utilize a rotating bolt and a cam pin arrangement.

DETAILED DESCRIPTION OF THE DRAWINGS

Figure 1:
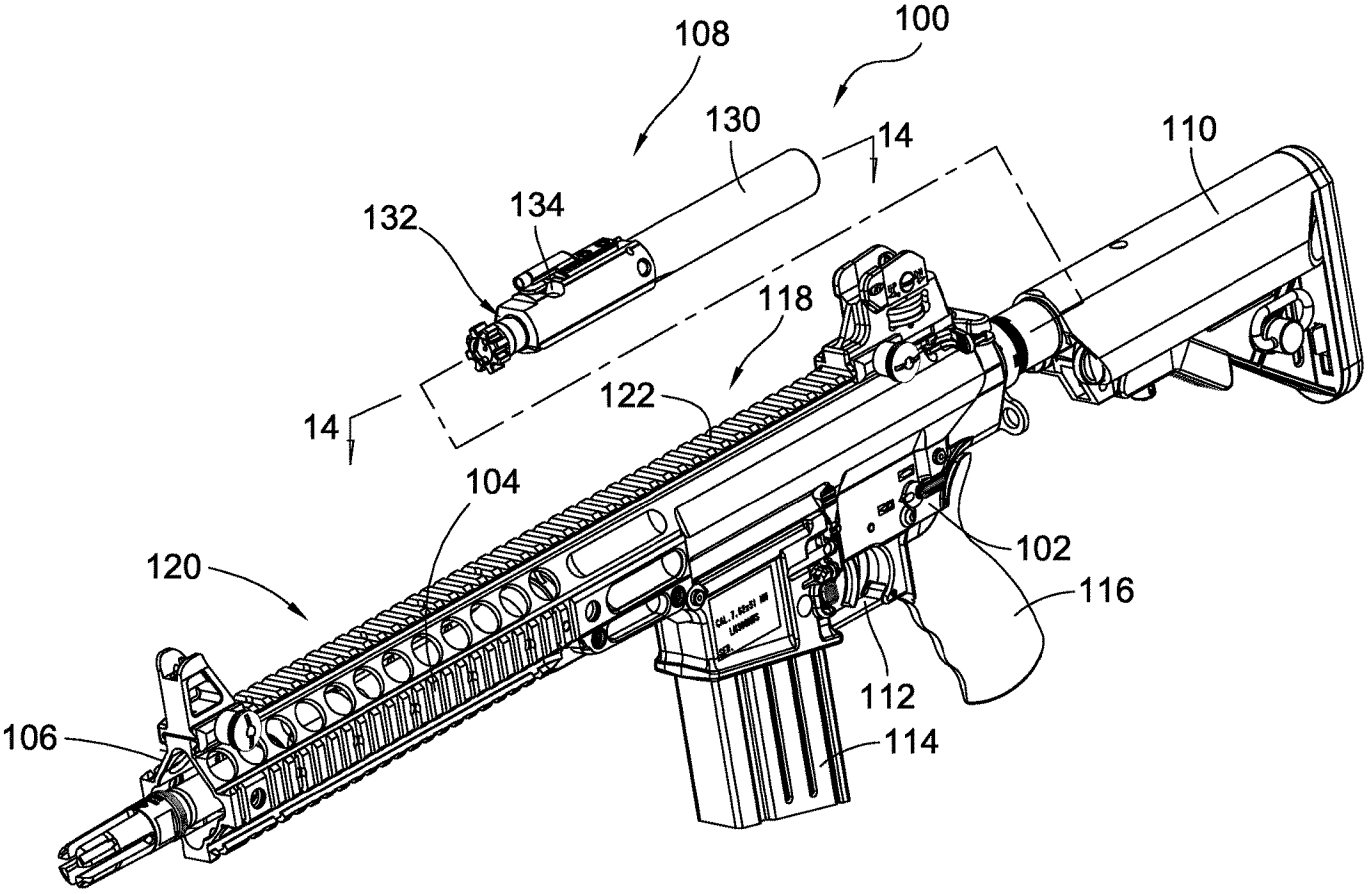
FIG. 1 is a perspective assembly view of a rifle incorporating an exemplary bolt carrier system.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

Referring to FIG. 1, a rifle 100 is illustrated. Rifle 100 is configured for use with 7.62 mm×51 mm NATO rounds and is similar in some respects to versions configured for .308 Winchester and 5.56 mm×45 mm NATO rounds. The illustrated rifle is manufactured by Lewis Machine & Tool Co. in Milan, Ill. Rifle 100 includes lower receiver 102, integral upper receiver and hand guard portion 104, barrel assembly 106 and bolt carrier group assembly 108. Lower receiver 102 includes stock 110, trigger assembly 112, magazine 114 and handle 116.

Integral upper receiver and hand guard portion 104 includes upper receiver portion 118 and hand guard portion 120. An upper rail 122 extends across upper receiver portion 118 and hand guard portion 120. In the illustrated embodiment, integral upper receiver and hand guard portion 104 is unitarily constructed of a single piece. However in other embodiments, integral upper receiver and hand guard portion 104 may be constructed from a plurality of pieces joined together. In yet other embodiments, integral upper receiver and hand guard portion 104 may be replaced with a conventional upper receiver and detachable hand guard portion as is well known in the art.

Figure 2:
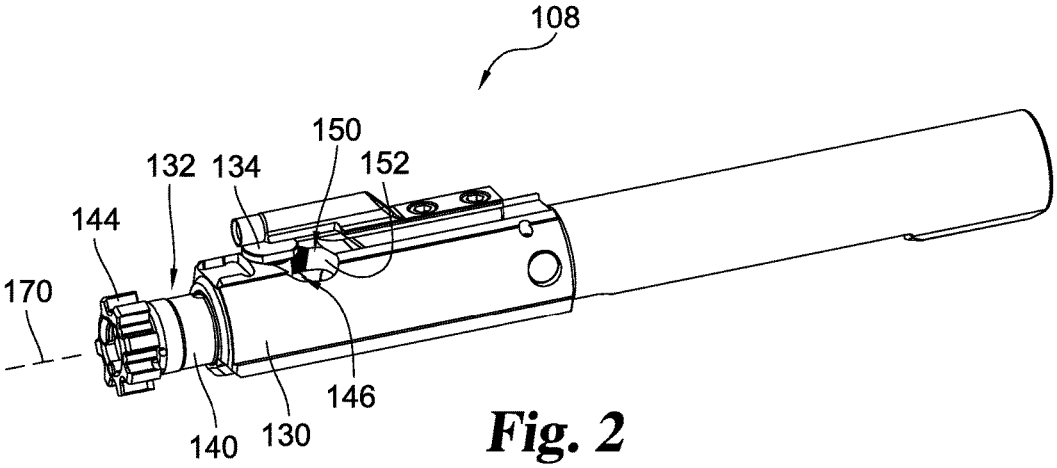
FIG. 2 is a perspective view of a forward end of a bolt carrier group assembly with the bolt in an extended, unlocked configuration.
Figure 3:
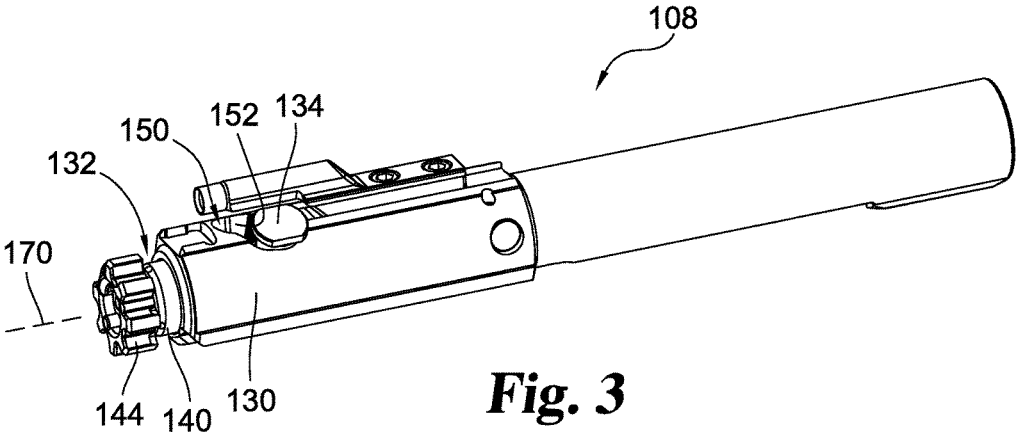
FIG. 3 is a perspective view of a forward end of a bolt carrier group assembly with the bolt in a retraced, locked configuration.

Referring now to FIG. 2-3, bolt carrier group assembly 108 includes a bolt carrier 130, a bolt assembly 132, and a cam pin 134. Bolt assembly 132 is slidably and rotatably mounted in bolt carrier 130. Bolt assembly 132 includes a bolt 140 having lugs 144 at the forward end of bolt 140 that releasably interlock with a portion of barrel assembly 106. A firing pin (not shown) extends through a central bore through bolt 140. Cam pin 134 extends through a cam slot 150 defined in bolt carrier 130 and extends into a cam pin opening 146 in bolt 140 (as shown in FIGS. 5 and 6).

Figure 4:
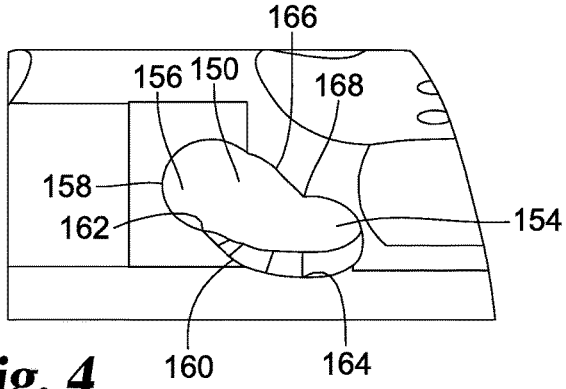
Fig. 4 (PRIOR ART)
FIG. 4 is a top view of a forward portion of a bolt carrier.

As best shown in FIG. 4, Cam slot 150 extends longitudinally along and circumferentially around a portion of bolt carrier 130. When bolt carrier group assembly 108 is in an unlocked configuration, as shown in FIG. 2, bolt assembly 132 is in an extended position from the end of bolt carrier 130 and cam pin 134 is positioned at a forward end of cam slot 150. When bolt carrier group assembly 108 is in a locked configuration, as shown in FIG. 3, bolt assembly 132 is in a retracted position and cam pin 134 is positioned at a rearward end of cam slot 150. As bolt assembly 132 transitions between the unlocked and locked configurations, cam pin 134 travels along a locking cam path, contacting and sliding along sides 152 of cam slot 150, causing bolt assembly 132 to rotate about and move along longitudinal axis 170 of bolt carrier 130. For example, with reference now to FIG. 4, cam slot 150 includes locked position 154, unlocked position 156, forward edge 158, unlocking cam path 160, delay ridge 162, end of unlock dwell 164, locking cam path 166, and delay ridge 168. In the locked configuration, cam pin 134 is located at locked position 154. In the unlocked configuration, cam pin 134 is located at unlocked position 156. As bolt assembly 132 moves from locked position 154 to unlocked position 156, cam pin 134 slides past delay ridge 168 and along unlocking cam path 160 into unlocked position 156, eventually coming into contact with forward edge 158. As bolt assembly 132 moves from unlocked position 156 into locked position 154, cam pin 134 slides past delay ridge 162 and along locking cam path 166 into locked position 154.

Figure 5:
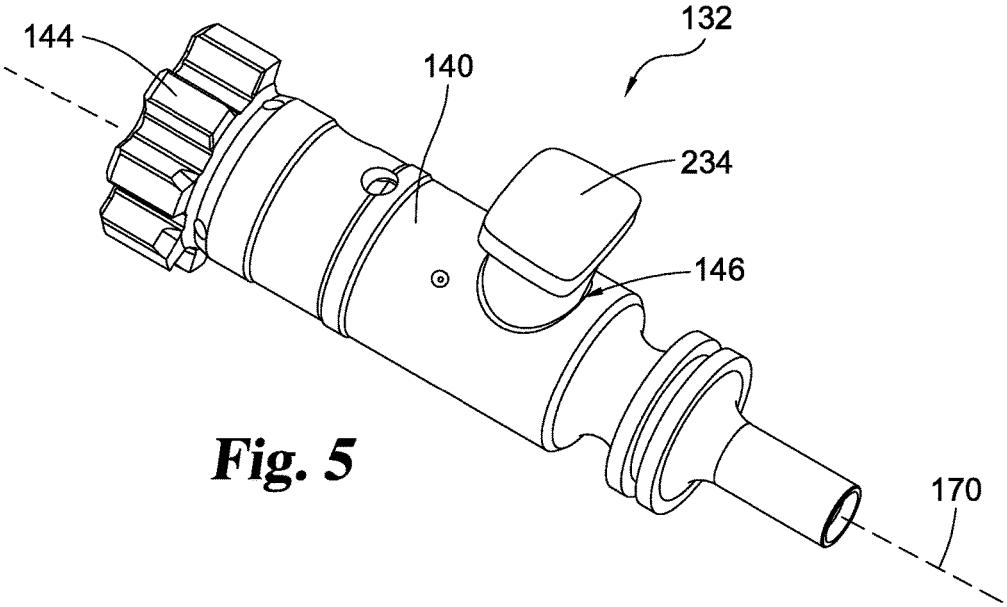
FIG. 5 is a front perspective view of a bolt assembly and cam pin.
Figure 6:
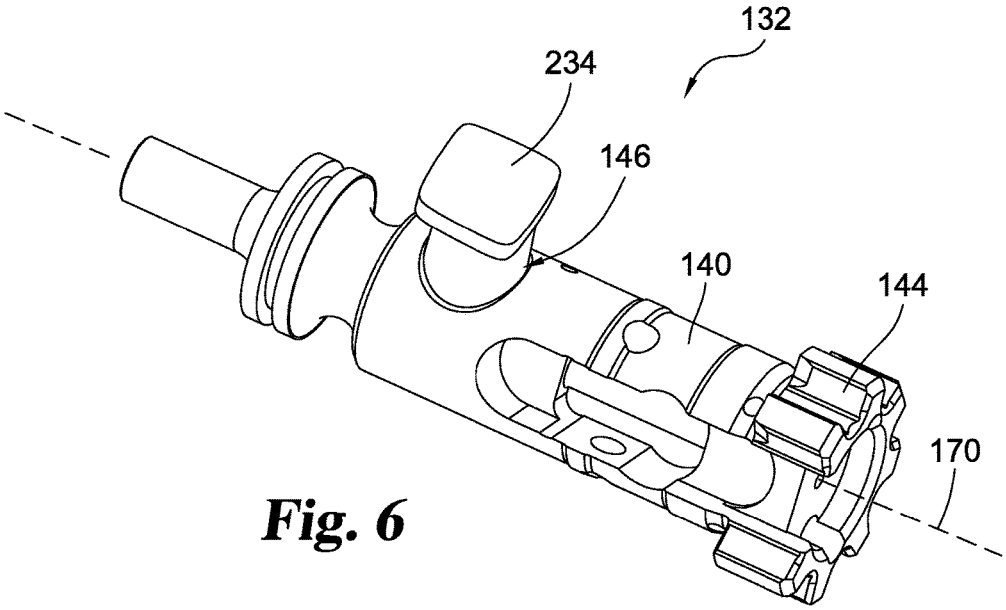
FIG. 6 is a back perspective view of the FIG. 5 bolt assembly and cam pin.

FIGS. 5 and 6 illustrate the cooperation of bolt 140 and a cam pin 234. As mentioned above, cam pin 234 extends into cam pin opening 146 defined in bolt 140. Rotation of cam pin 234 around longitudinal axis 170 of bolt carrier 130 causes rotation of bolt 140 around longitudinal axis 170. Therefore, as cam pin 234 moves along a length of bolt carrier 130 and contacts sides 152 of cam slot 150, cam pin 234 rotates around longitudinal axis 170 and bolt 140, in turn, rotates around longitudinal axis 170 so that lugs 144 of bolt 140 can lock or unlock with a barrel extension (not shown).

Figure 7:
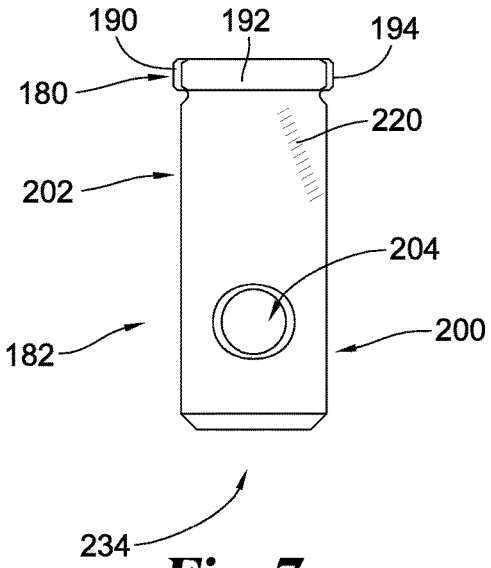
FIG. 7 is a front elevational view of a cam pin.
Figure 8:
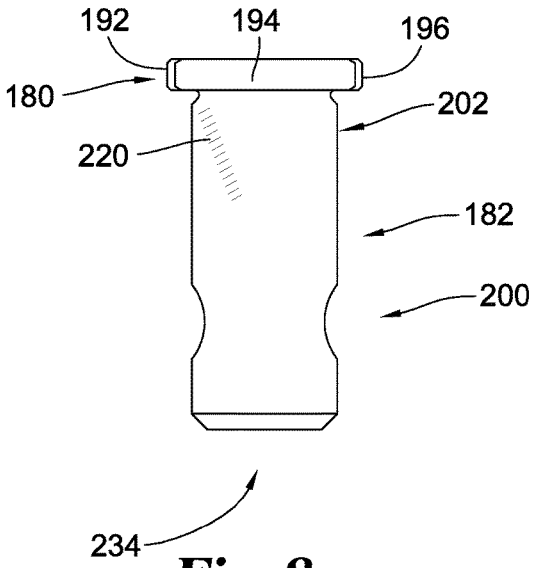
FIG. 8 is a side elevational view of the cam pin of FIG. 7.
Figure 9:
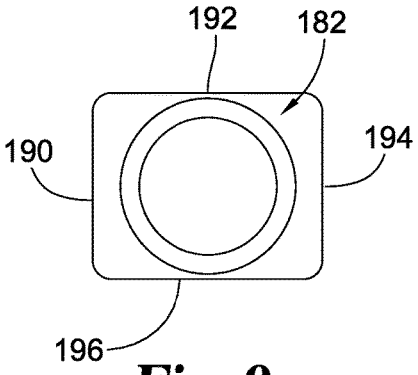
FIG. 9 is a bottom plan view of the cam pin of FIG. 7.
Figure 10:
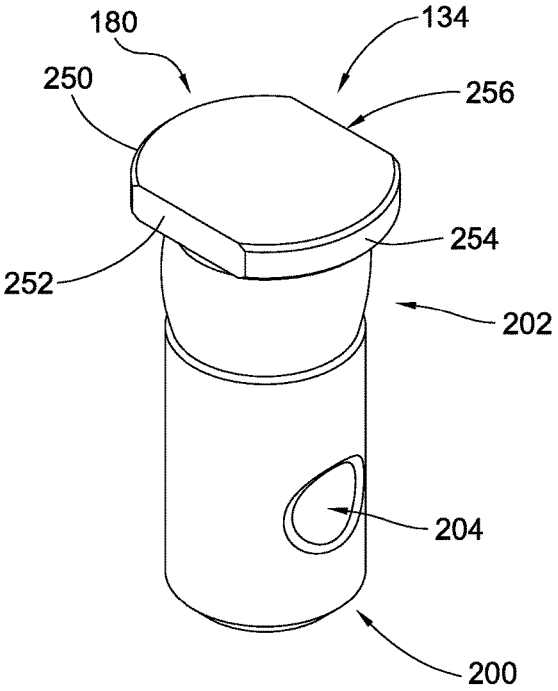
FIG. 10 is a perspective view of another cam pin.
Figure 11:
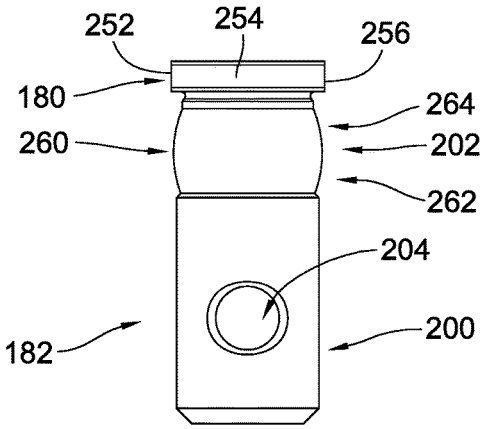
FIG. 11 is a front elevational view of the cam pin of FIG. 10.
Figure 12:
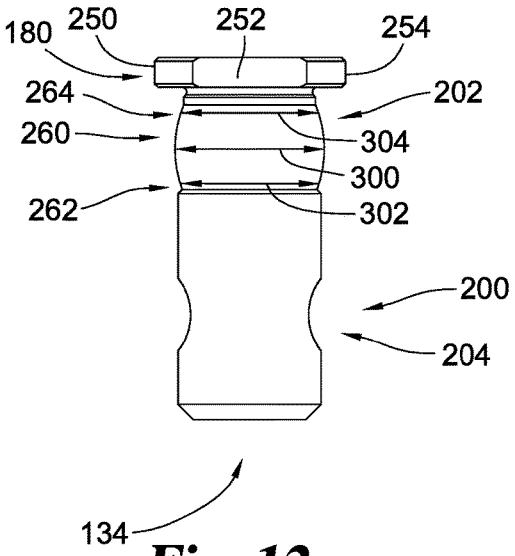
FIG. 12 is a side elevational view of the cam pin of FIG. 10.
Figure 13:
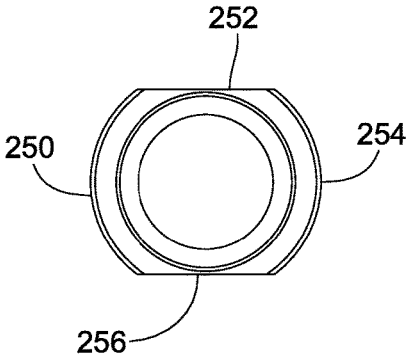
FIG. 13 is a bottom plan view of the cam pin of FIG. 10.
Figure 14:
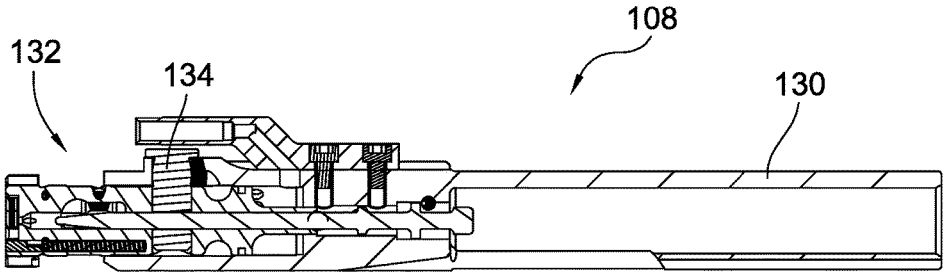
FIG. 14 is a cross-sectional view of a bolt carrier group assembly of FIG. 1 taken along line 14-14 with the cam pin of FIG. 10.
Figure 15:
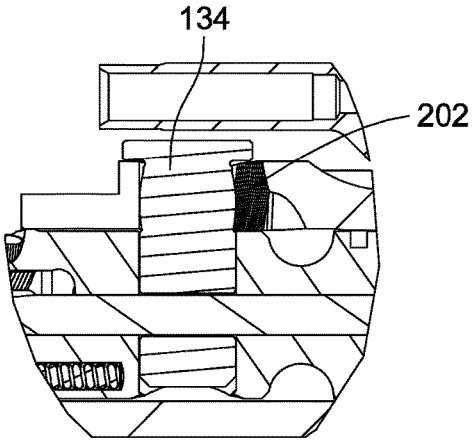
FIG. 15 is a close-up view of the cam pin portion of FIG. 14.
Figure 16:
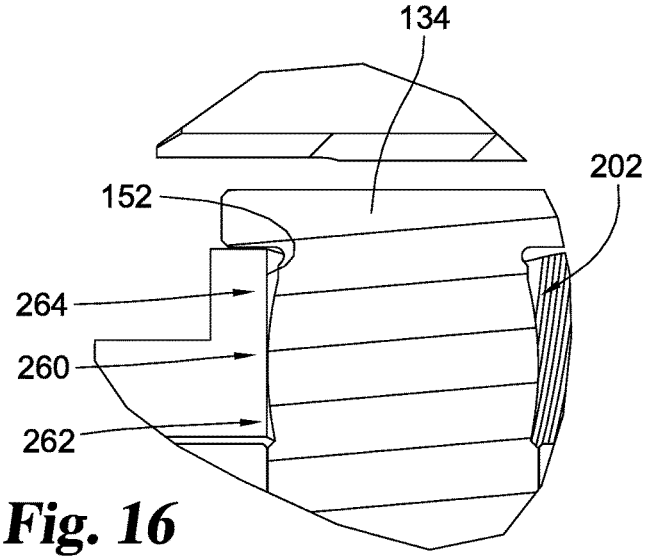
FIG. 16 is a close-up view of the cam-slot engaging section of the cam pin of FIG. 15.

A prior art cam pin 234 that was subjected to extended use testing by Applicant is illustrated in FIGS. 7-9. Cam pin 234 has a head portion 180 and a cylindrical body portion 182. Head portion 180 has a generally rectangular cross-sectional shape defining side surfaces 190, 192, 194, and 196. When bolt carrier group assembly 108 is in the unlocked configuration, head portion 180 is slidably received within a gas key and charging handle groove defined in upper receiver portion 118.

Cylindrical body portion 182 includes a bolt engaging segment 200 and a cam-slot engaging segment 202. Bolt engaging segment 200 defines an aperture 204 for receiving a firing pin and is sized and arranged to be received within cam pin opening 146 of bolt 140. Cam-slot engaging segment 202 is arranged to slidably engage portions of cam slot 150 when bolt assembly 132 is received within bolt carrier 130 and bolt engaging segment 200 of cam pin 234 is received within cam pin opening 146 of bolt 140.

Applicant found that a cam pin can experience fretting and/or galling along cam slot engaging segment 202 from the repeated cycling of the firearm. For instance, Applicant has observed wear marks 220 on the portions of cam slot engaging segment that slide along sides 152 of cam slot 150. Furthermore, Applicant observed increased 220 wear along cam slot engaging portion nearer head portion than bolt engaging segment. Applicant considers this to be likely due to the cam slot engaging portion being farther away from the axis of rotation (i.e., longitudinal axis 170, such as the firing pin) and therefore having to travel a greater distance during rotation than portion(s) of cam pin 234 located closer to the longitudinal axis 170.

Additionally, as cam pin 234 rotates around longitudinal axis 170, portions of cam pin 234 positioned farther from longitudinal axis 170 travel at a greater velocity around longitudinal axis 170 than portions of cam pin 234 positioned nearer to longitudinal axis 170. This results in a velocity gradient along a length of cam pin 234 and, in particular, along cam slot engaging segment 202. Accordingly, portions of cam slot engaging segment 202 slide along sides 152 of cam slot 150 at velocities of different magnitude and travel different distances each actuation. This, Applicant believes, causes a relative shear stress along portions of cam slot engaging segment 202, increasing the likelihood of and/or instance of fretting and/or galling and possibly the release of metal particles into the action of rifle 100, which may potentially result in and/or contribute to a weapon malfunction.

Wear marks 220 along cam slot engaging segment 202 found during Applicant's testing is shown in FIGS. 7 and 8. In some instances, this wear may result in increased friction between bolt carrier 130 and cam pin 234 and/or structural failure of cam pin 234, possibly resulting in a malfunction of the firearm. To address this issue, Applicant developed novel cam pin 134 shown in FIGS. 10-13. Cam pin 134, as shown in FIGS. 10-13, has a head portion 180 and a cylindrical body portion 182. Head portion 180 has curved and linear side surfaces 250, 252, 254, and 256, with opposing sides 252 and 256 being linear and parallel with opposing side surfaces 250 and 254 being curved.

Cylindrical body portion 182 includes a bolt engaging segment 200 and a cam-slot engaging segment 202. Cylindrical body portion 182 has a length and a profile that includes linear portions, curved portions, and/or stepped portions along a portion of the length. Bolt engaging segment 200 defines an aperture 204 for receiving a firing pin and is sized and arranged to be received within cam pin opening 146 of bolt 140. Cam-slot engaging segment 202 is arranged to slidably engage portions of sides 152 in cam slot 150 when bolt assembly 132 is received within bolt carrier 130 and bolt engaging segment 200 of cam pin 134 is received within cam pin opening 146 of bolt 140.

As shown in FIGS. 10-16, cam slot engaging segment 202 has a curved profile. Central portion 260 of cam slot engaging segment 202 has a cross-sectional dimension 300 (e.g., diameter) measured in a cross-sectional plane of cam pin 134. End portion 262 of cam slot engaging segment 202 near bolt engaging segment 200 has a cross-sectional dimension 302, and end portion 264 of cam slot engaging segment 202 near head portion 180 has a cross-sectional dimension 304. Both cross-sectional dimension 302 and cross-sectional dimension 304 are less than cross-sectional dimension 300 of central portion 260. In this way, cam slot engaging segment 202 only contacts sides 152 of cam slot 150 along central portion 260, which reduces the magnitude of the velocity gradient along the length of cam pin 134 that contacts sides 152 of cam slot 150, potentially reducing the likelihood and/or instance of fretting and/or galling.

While the above embodiments have been illustrated and described with the cam slot engaging portion having a curved profile, it is contemplated that the cam slot engaging segment may additionally or alternatively include a stepped, sloped, tapered or otherwise shaped profile.

While the present disclosure has been illustrated and described in detail in the drawings and foregoing description, the same is to be considered as illustrative and not restrictive in character, it being understood that a preferred embodiment has been shown and described and that all changes, equivalents, and modifications that come within the spirit of the invention defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The language used in the claims and the written description and in the above definitions is to only have its plain and ordinary meaning, except for terms explicitly defined above. Such plain and ordinary meaning is defined here as inclusive of all consistent dictionary definitions from the most recently published (on the filing date of this document) general purpose Merriam-Webster dictionary.

As used in the claims and the specification, the following terms have the following defined meanings:

The term "curvilinear" as used herein has the meaning, having at least one curve. It includes, but is not limited to, being fully curved as well as including one or more linear segments. It includes curves with a constant radius as well as non-constant radii of curvature.

The term "fretting" as used herein has the meaning, damage induced under load and in the presence of repeated surface motion. Fretting tangibly downgrades the surface layer quality, producing increased surface roughness and micropits, which reduces the fatigue strength of the components.

The term "galling" as used herein has the meaning, wear caused by adhesion between sliding surfaces that causes material of a first surface to be pulled with the contacting surface. Galling can, in many instances, leave some material from a first surface attached to the contacting second surface, potentially appearing as a bulge on the second surface with a gouge in the first surface.

The term "M16" as used herein includes military, civilian, semi-automatic and automatic versions of the M16 rifle. This includes but is not limited to the AR-15, M16A1, M16A2, M16A3, M16A4 and M4A1 rifles. The term "M16," as used herein, is inclusive of versions of the M16 rifle chambered for .223 Remington, 5.56 NATO, 7.62 NATO, and .308 Winchester and as well as pistol versions (i.e., versions without a buttstock) and short-barreled rifle ("SBR") versions as similar bolt carrier assembly are used in all these variants.

The term "profile" as used herein has the meaning, the outline shape of an object along its length. The term includes the silhouette of an object.

The term "wear" as used herein has the meaning, the removal and/or deformation of material on a surface as a result of mechanical interaction with an interfacing surface. The term includes a loss of dimension from plastic deformation as well as impact or impulse wear.

What is claimed is:

1. A cam pin configured for a bolt carrier system of a rotating bolt firearm, the cam pin; comprising:

a head portion and an elongate body extending from the head portion;

the elongate body having a cam slot engaging segment and a bolt engaging segment;

wherein said cam slot engaging segment having a first portion with a first cross-sectional dimension and a second portion with a second cross-sectional dimension;

wherein said cam slot engaging segment is configured to engage with a slot in a bolt carrier of the bolt carrier system;

wherein said first cross-sectional dimension being greater than said second cross-sectional dimension; and wherein said first portion being located between said head portion and said second portion.

2. The cam pin of claim 1, wherein:

the cam slot engaging segment has a sloped profile along a length of the cam slot engaging segment that includes both the first and second portions.

3. The cam pin of claim 1, wherein:

the cam slot engaging segment has a curved profile extending along a length of the cam slot engaging segment and including both the first and second portions.

4. The cam pin of claim 1, wherein:

the cam slot engaging segment has a stepped profile along a length of the cam slot engaging segment and including both the first and second portions.

5. The cam pin of claim 1, wherein:

said cam slot engaging segment has a cross-sectional dimension equal to or less than a cross-sectional dimension of said bolt engaging segment.

6. The cam pin of claim 1, wherein:

said cam slot engaging segment has a central portion, a first end, and a second end;

said first end positioned between said central portion and said head portion and said second end positioned between said central portion and said bolt engaging portion; and wherein said central portion of said cam slot engaging segment has a greater cross-sectional dimension than said first end of said cam slot engaging segment.

7. The cam pin claim 1, wherein:

said cam pin is adapted to fit and be useable with an M16 or M4 bolt and bolt carrier.

8. A bolt carrier group kit, comprising: a bolt carrier defining a cam slot;

a bolt including a lug and defining a cam pin opening, said bolt slidably and rotatably receivable within said bolt carrier; and a cam pin having a head portion and an elongate body extending from the head portion, wherein said elongate body has a cam slot engaging segment and a bolt engaging segment;

wherein said cam slot engaging segment engages with said cam slot when said cam pin is received in said cam pin opening and said bolt is received in said bolt carrier;

wherein said cam slot engaging segment has a first portion with a first cross-sectional dimension and a second portion with a second cross-sectional dimension;

wherein said first cross-sectional dimension is greater than said second cross-sectional dimension; and wherein said first portion is located between said head portion and said second portion.

9. The kit of claim 8, wherein:

the cam slot engaging segment has a sloped profile along a length of the cam slot engaging segment and including both the first and second portions.

10. The kit of claim 8, wherein:

the cam slot engaging segment has a curved profile extending along a length of the cam slot engaging segment and including both the first and second portions.

11. The kit of claim 8, wherein:

said cam slot engaging segment has a cross-sectional dimension equal to or less than a cross-sectional dimension of said bolt engaging segment.

12. The kit of claim 8, wherein:

said cam slot engaging segment has a central portion, a first end, and a second end;

wherein said first end positioned between said central portion and said head portion and said second end positioned between said central portion and said bolt engaging portion; and wherein said central portion of said cam slot engaging segment has a greater cross-sectional dimension than said first end of said cam slot engaging segment.

13. The kit of claim 8, wherein:

said bolt is received within said bolt carrier; and wherein said cam pin is received within said cam pin opening and said cam slot.

14. The kit of claim 8, wherein:

said bolt carrier is constructed and arranged to fit and be useable with an M16 or M4.

15. A rotating bolt firearm, comprising: a lower receiver; an upper receiver coupled to said lower receiver;

a barrel assembly coupled to said upper receiver, said barrel assembly including a barrel extension;

a bolt carrier group assembly movably received in the upper receiver, said bolt carrier group assembly including a bolt assembly and a bolt carrier defining a cam slot; and a cam pin having a head portion and an elongate body extending from the head portion, wherein said elongate body has a cam slot engaging segment and a bolt engaging segment;

wherein said bolt assembly is slidably and rotatably receivable within said bolt carrier and includes a lug that is lockable and unlockable with said barrel extension, wherein said bolt assembly defines a cam pin opening;

wherein said cam pin is received in said cam pin opening and said cam slot engaging segment is received in and engagable with said cam slot;

wherein said cam slot engaging segment has a first portion with a first cross-sectional dimension and a second portion with a second cross-sectional dimension;

wherein said first cross-sectional dimension is greater than said second cross-sectional dimension; and wherein said first portion is located between said head portion and said second portion.

16. The firearm of claim 15, wherein:

the cam slot engaging segment has a curved profile extending along a length of the cam slot engaging segment and including both the first and second portions.

17. The firearm of claim 16, wherein:

said cam slot engaging segment has a cross-sectional dimension equal to or less than a cross-sectional dimension of said bolt engaging segment.

18. The firearm of claim 15, wherein:

said cam slot engaging segment has a central portion, a first end, and a second end;

wherein said first end positioned between said central portion and said head portion and said second end positioned between said central portion and said bolt engaging portion; and wherein said central portion of said cam slot engaging segment has a greater cross-sectional dimension than said first end of said cam slot engaging segment.

19. The firearm of claim 15, wherein:

the cam slot engaging segment has a sloped profile along a length of the cam slot engaging segment and including both the first and second portions.

20. The firearm of claim 15, wherein:

said lower receiver is part of an M16 or M4.

* * * * *